US008807795B2

(12) United States Patent
Hsu et al.

(10) Patent No.: US 8,807,795 B2
(45) Date of Patent: Aug. 19, 2014

(54) LED LIGHTING DEVICE

(75) Inventors: Hui-Ju Hsu, Taichung (TW); Hong-Ping Liu, Taichung (TW); Yen-Wei Ho, Taichung (TW)

(73) Assignee: Genius Electronic Optical Co., Ltd., Taichung (TW)

( * ) Notice: Subject to any disclaimer, the term of this patent is extended or adjusted under 35 U.S.C. 154(b) by 15 days.

(21) Appl. No.: 13/589,495

(22) Filed: Aug. 20, 2012

(65) Prior Publication Data

US 2013/0322080 A1 Dec. 5, 2013

(30) Foreign Application Priority Data

May 31, 2012 (TW) ..... 101119564 A

(51) Int. Cl.
*F21S 4/00* (2006.01)

(52) U.S. Cl.
USPC ..... 362/249.02; 362/218; 362/225

(58) Field of Classification Search
USPC ..... 362/249.02, 218, 225
See application file for complete search history.

(56) References Cited

U.S. PATENT DOCUMENTS

2011/0210664 A1* 9/2011 Hisayasu et al. ..... 315/32

FOREIGN PATENT DOCUMENTS

TW M354129 4/2009

OTHER PUBLICATIONS

TW Office Action dated Apr. 22, 2014.

* cited by examiner

*Primary Examiner* — Sean Gramling
(74) *Attorney, Agent, or Firm* — Muncy, Geissler, Olds & Lowe, P.C.

(57) ABSTRACT

An LED lighting device at least comprises a base made of metal materials; a substrate which is disposed on a surface of the base and has one electrode and at least one LED chip; and an insulation sheet which is disposed between the base and the substrate. The insulation sheet and the substrate satisfy the correlations $L2+2\times T \geq L1+2\times Cr$, $W2+2\times T \geq W1+2\times Cr$ and $Cr \geq 1.6$ mm. By controlling the dimension of the insulation sheet, a creepage distance between the electrode and the base can be increased, so as to solve the safety problem of lighting devices without increasing manufacturing costs.

6 Claims, 5 Drawing Sheets

LED LIGHTING DEVICE

INCORPORATION BY REFERENCE

This application claims priority from Taiwan Patent Application No. 101119564, filed on May 31, 2012, the contents of which are hereby incorporated by reference in their entirety for all purposes.

BACKGROUND OF THE INVENTION

1. Field of Invention

The present invention is related to an LED lighting device, and more particularly to a lighting device which needs to comply with the safety standards of minimum creepage distances.

2. Related Art

Currently, for achieving the requirements of energy saving and environmental protection, the manufactures and the research & development unit of the lighting devices are gradually adopting LEDs as the light source of lighting devices. LED is a solid-state semiconductor device that can convert electrical energy directly into light. The LEDs have the advantages of small volume, fast response speed, low power consuming, and low pollution.

However, the lighting devices belong to electronic products. Safety standards are required to be considerate to ensure that personal safety wouldn't be endangered and property and environment wouldn't be harmed in use. For the safety standards of LEDs, different countries enacted different standards for different working voltages.

IEC (International Electrotechnical Commission) regulates the safety standards of the lighting products under a working voltage of 1000V in IEC 60598-1 (Luminaires—Part 1: General requirements and tests), where standards of creepage distance for different working voltage are defined. Creepage distance is the shortest path between two conductive parts (or between a conductive part and the bounding surface of the equipment) measured along the surface of the insulation. If the creepage distance is not enough, it may incur dielectric breakdown caused by electric leakages or insulation failure.

In order to solve the above mentioned problems, most of designers may drive LEDs in parallel, so that the working voltages of the whole system can be lower than Safety Extra Low Voltage (SELV). The SELV means that a voltage between conductors or between any conductor and earth does not exceed the standard voltage. No values of creepage distance are specified for working voltages below SELV. Therefore, when the working voltage of a lighting device is below SELV, the creepage distance is not needed to be considered. Moreover, different countries may have different standards for the SELV. However, because the internal resistances of each LED are different, parallel connection may cause a problem of uneven electric current, which may affect the lighting uniformity of the lighting devices and lower the life span of the LEDs. In addition, in order to solve the problem of uneven electric current for each LED, an additional current control IC is used for controlling the electric current of each LED by the manufactures. Nevertheless, as the demand for wattage is increased, the number of LED is increased; therefore, the number of ICs is increased as well as manufacturing costs, so that it is not a perfect way to solve the problem.

Therefore, how to improve the structure of lighting device so that the lighting device can meet the standard requirements for creepage distances without increasing manufacturing costs is the problem to be solved.

SUMMARY OF THE INVENTION

It is an object of the present invention to provide an LED lighting device, in which an insulation sheet is disposed between a substrate and a base, such that the shortest distance between edges of the substrate and the base measured along the surface of the insulation sheet can meet the creepage distance standards without additional manufacturing costs.

Another object of the present invention is to provide an LED lighting device, in which an insulation sheet is disposed between a substrate and a base, the insulation sheet can further have thermal conduction and conducts the heat from the substrate to the base made of metal, so as to achieve a heat dissipating effect.

To achieve the above-mentioned objects, the present invention discloses an LED lighting device, and the LED lighting device at least comprises: a base made of metal; at least one substrate disposed on a surface of the base, the substrate having at least one electrode and at least one LED chip electrically connected with the electrode; and at least one insulation sheet disposed between the base and the substrate, the insulation sheet and the substrate satisfying the correlations $L2+2\times T \geq L1+2\times Cr$, $W2+2\times T \geq W1+2\times Cr$ and $Cr \geq 1.6$ mm; wherein Cr is the shortest distance between edges of the substrate and the base measured along the surface of the insulation sheet, L1 is the length of the substrate, L2 is the length of the insulation sheet, W1 is the width of the substrate, W2 is the width of the insulation sheet, and T is the thickness of the insulation sheet.

In one embodiment of the present invention, the base is a case, and the base further includes a plurality of heat dissipation fins.

In one embodiment of the present invention, the LED lighting device comprises a plurality of substrates and a plurality of insulation sheets, and each insulation sheet is provided for a plurality of substrates to be disposed thereon.

In one embodiment of the present invention, the thickness of the insulation sheet is greater than or equal to 0.4 mm; the insulation sheet further includes a function of thermal conduction, and the thermal conductivity of the insulation sheet is greater than or equal to 1 W/m-K.

By disposing an insulation sheet between a substrate and a base, the shortest distance between edges of the substrate and the base measured along the surface of the insulation sheet can meet the creepage distance standards, so as to avoid hazards caused by a lighting device which does not comply with the safety standards. In addition, the cost of the insulation sheet is low, such that the lighting device can comply with the creepage distance standards with a little cost. Besides, if the insulation sheet has thermal conduction, heat can be conducted from the substrate to the base made of metal, so as to achieve a heat dissipating effect. Preferably, the thermal conductivity of the insulation sheet is greater than or equal to 1 W/m-K, and the thickness of the insulation sheet is greater than or equal to 0.4 mm; when the thermal conductivity of the insulation sheet is less then 1 W/m-K, the insulation sheet has poor thermal conduction and unable to conduct heat to the base effectively, such that the temperature of the LED may easily beyond the working temperature, which may lower the brightness and reduce the life span of the LED. When the thickness of the insulation sheet is less than 0.4 mm, the distance through insulation will be insufficient, such that the insulation reliability will be lower and can't meet the insulation requirement, which leads to a downgrade of safety for the lighting device.

DETAILED DESCRIPTION OF THE INVENTION

The detail and technical specification of the present invention will be further explained through the embodiments. However, it should be understood that the embodiments are used as examples, and should not be limited thereto.

Figure 1:
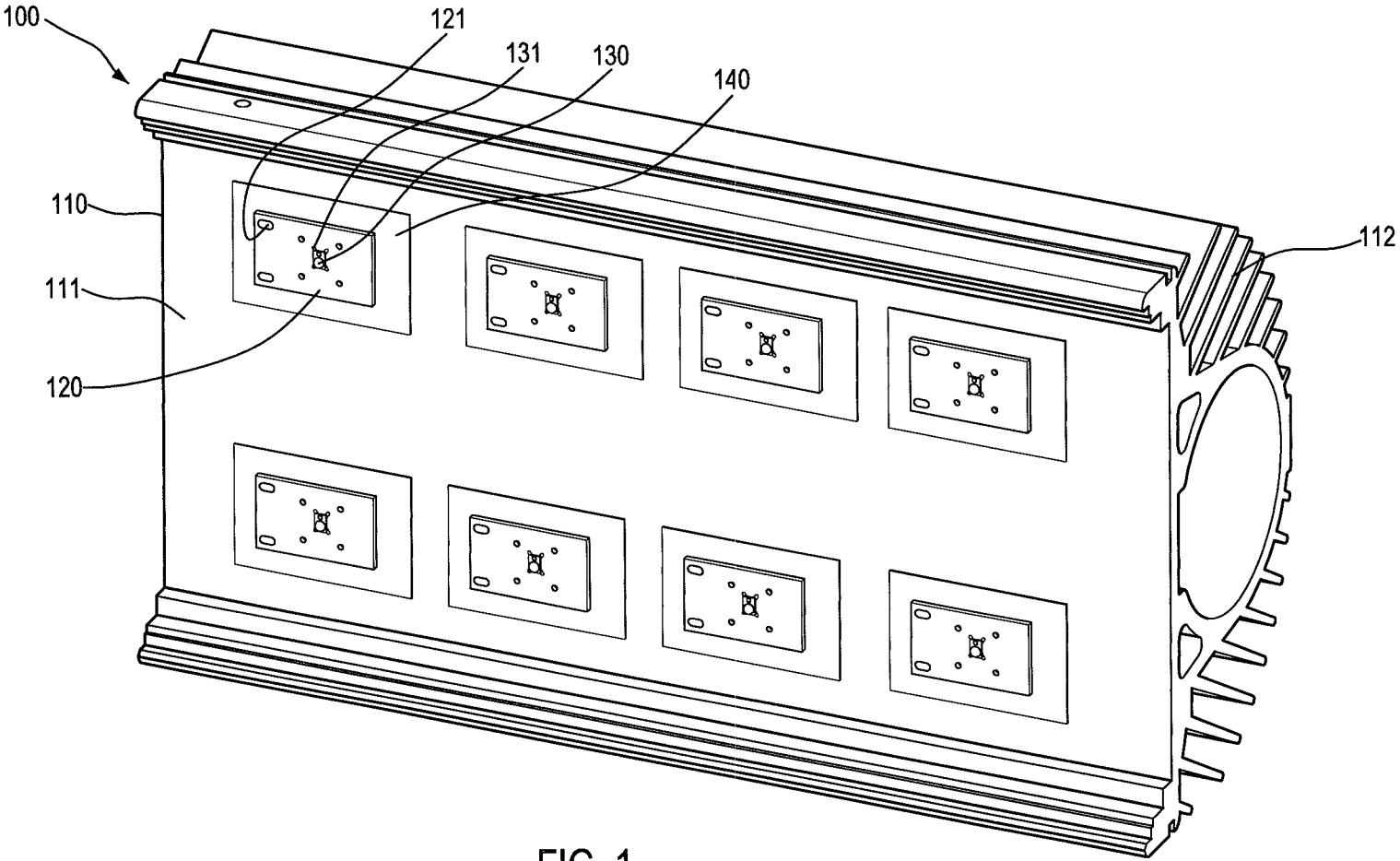
FIG. 1 is a perspective view of a lighting device according to a first preferred embodiment of the present invention.
Figure 2:
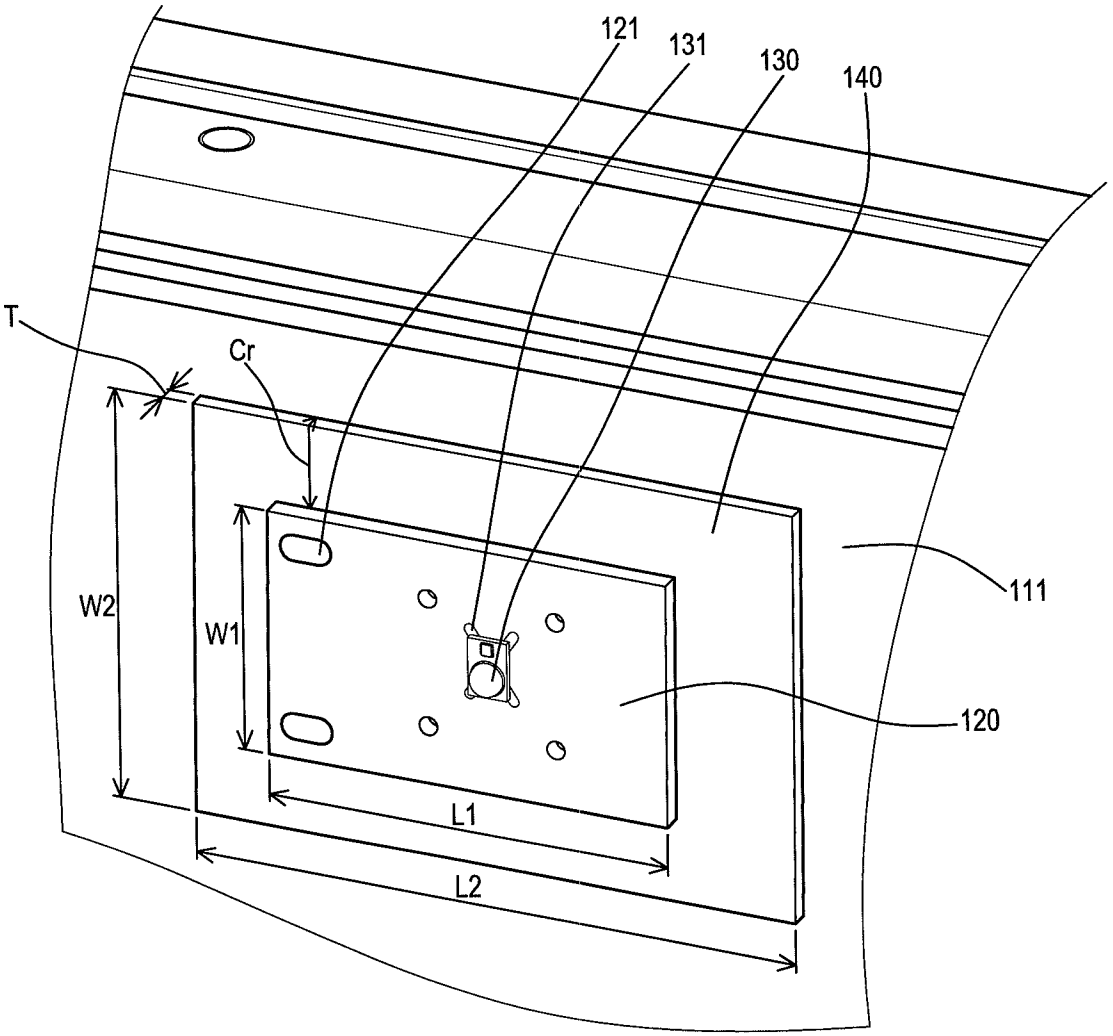
FIG. 2 is a partial enlarge view of FIG. 1.
Figure 3:
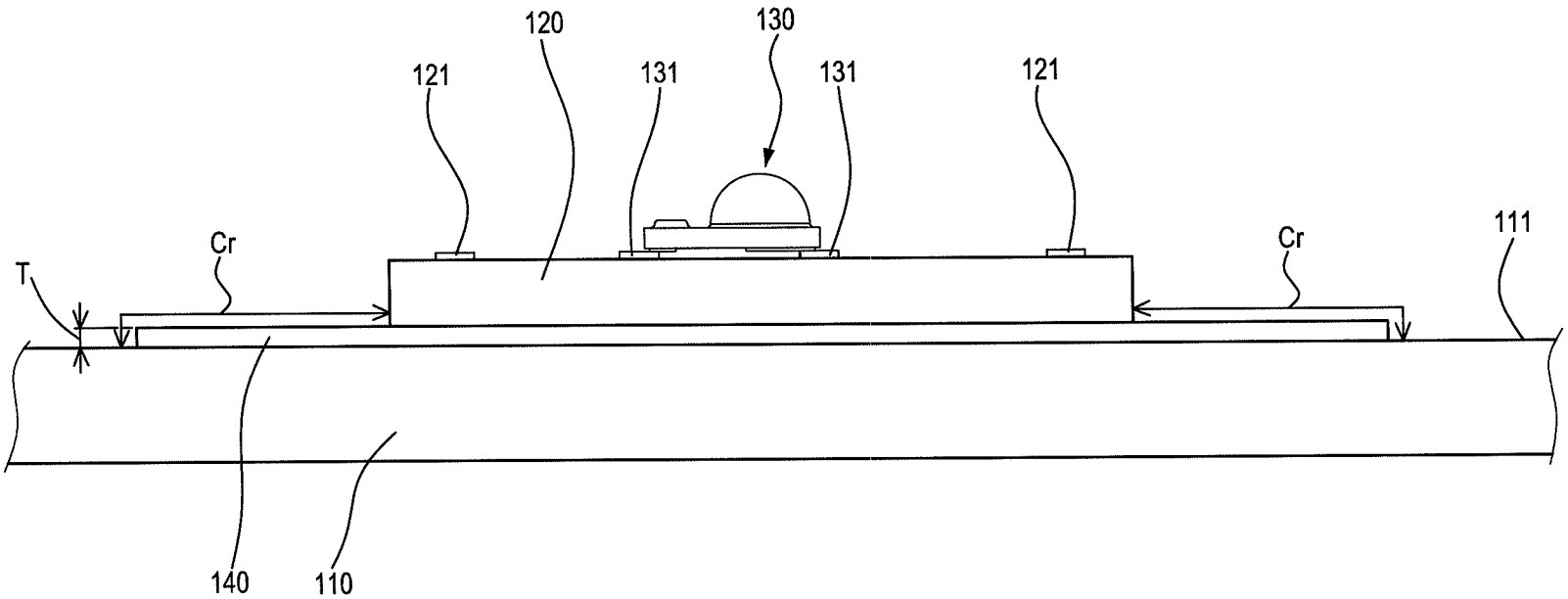
FIG. 3 is a side view of a lighting device according to the first preferred embodiment of the present invention.

Please refer to FIGS. 1, 2, and 3, the lighting device 100 according to a first preferred embodiment of the present invention at least comprises a base 110 made of metal, and the base 110 may be used as a case of the lighting device 100. The base 110 may further comprise heat dissipation fins 112, so as to increase heat dissipation effect of the base 110.

A plurality of substrates 120 are disposed on a surface 111 of the base 110 and each substrate 120 provides two electrodes 121 for electrically connecting with a main power source (not shown). A plurality of LED chips 130 are mounded on the substrates 120 and internally connected with the electrode 121.

In addition, a plurality of insulation sheet 140 are disposed between the substrates 120 and the base 110, and the shortest distance between edges of the substrate 120 and the base 110 measured along the surface of the insulation sheet 140 is longer than or equal to 1.6 mm.

The substrate 120 may be a printed circuit board (PCB), a metal core PCB (MCPCB), a ceramic substrate made of ceramics, or a direct bonded copper (DBC) substrate. PCB and MCPCB can be used in general LED products; however, as heat flux increases, the requirement of the heat dissipation appears to be more important. Therefore, the LED substrate adopting metal substrate and ceramic substrate enhances the heat dissipation. Moreover, the technologies for manufacturing the substrate 120 are available in the market and disclosed in published or issued patents, and the connection structures of the electrode 121 of the substrate 120 with the LED chip 130 are also conventional art, such that they will not be described herein.

In practice, for heat dissipation consideration, mostly the substrate 120 is made of metal materials and coated with an insulation layer. In view of US safety standards, although the substrate 120 made of metal materials is coated with an insulation layer, the surface of insulation layer can't be considered as a part of creepage distance (UL 1598 6.11.8: For the purposes of measuring spacings, a film-coated conductor shall be considered an uninsulated part).

Therefore, in the present invention, the size of the insulation sheet 140 is determined according to the requirements of the size of the substrate 120 and the shortest distance between the electrode 121 and the base 110 measured along the surface of the insulation sheet 140, such that the lighting device 110 can comply with the minimum creepage distance for the designed working voltage of the safety standards. It is to be noted that since the insulation layer coated on the metal substrate 120 can not be considered as a part of the creepage distance, the creepage distance should be count from the edges of the substrate 120; therefore, the creepage distance is the shortest distance between edges of the substrate 120 and the base 110 measured along the surface of the insulation sheet 140.

In this embodiment, each insulation sheet 140 is provided for only one substrate 120 to be disposed thereon, and each substrate 120 is provided with an LED chip 130 and a set of electrodes for connecting with the main power source. In FIG. 1, the lighting device 100 has eight rectangle-shaped substrates 120 and eight rectangle-shaped insulation sheets 140. Define L1 as the length of the substrate 120, L2 as the length of the insulation sheet 140, W1 as the width of the substrate 120, W2 as the width of the insulation sheet 140, T as the thickness of the insulation sheet 140, Cr as the shortest distance between edges of the substrate 120 and the base 110 measured along the surface of the insulation sheet 140 (as shown in FIGS. 2 and 3).

In the designing process, the quantity of the LED chips 130 and working voltages of the lighting device 100 are depend on requirements of the illumination. After the working voltages being chosen, the creepage distances for safety standards are subsequently determined. So that the determination of Cr value is based on the creepage distance of different working voltages and different countries (Table 1 shows the minimum specification of creepage distance for the lighting devices in major countries and regions), and at least a condition of Cr≥1.6 mm must be satisfied (as the minimum specification of creepage distance shown in Table 1). As a result, the shortest distance Cr between edges of the substrate 120 and the base 110 measured along the surface of the insulation sheet 140 can comply with the safety standards of creepage distance of each country/region.

TABLE 1

| | working voltage | | | | | | |
|---|---|---|---|---|---|---|---|
| | <150 V | | | | <250 V | | |
| | Country | | | | | | |
| | CNS (Taiwan) | CQC (China) | CE (EU) | UL (USA) | CNS (Taiwan) | CQC (China) | CE (EU) |
| Basic insulation (mm) | 2.5 | 2.5 | 1.6 | — | 4 | 4 | 2.5 |
| Supplementary insulation (mm) | 3.2 | 3.2 | 1.6 | — | 4 | 4 | 2.5 |
| Reinforced insulation | 5.5 | 5.5 | 3.2 | 6.4 | 6.5 | 6.5 | 5 |

TABLE 1-continued (mm)

| | Working voltage | | | | |
|---|---|---|---|---|---|
| | <300 V | <500 V Country | | | <600 V |
| | UL (USA) | CNS (Taiwan) | CQC (China) | CE (EU) | UL (USA) |
| Basic insulation (mm) | — | 8 | 8 | 5 | — |
| Supplementary insulation (mm) | — | 8 | 8 | 5 | — |
| Reinforced insulation (mm) | 9.5 | 9 | 9 | 6 | 9.5 |

In table 1, the basic insulation is an insulation applied to live parts to provide basic protection against electric shock; the supplementary insulation is an independent insulation applied in addition to basic insulation in order to provide protection against electric shock in the event of a failure of basic insulation; the reinforced insulation is a single insulation system applied to live parts, which provides a degree of protection against electric shock equivalent to double insulation. (The double insulation is an insulation comprising both basic insulation and supplementary insulation.).

In one embodiment, eight LED chips 130 are used for example. The working current and voltage of the LED chip 130 are 1500 mA and 3.1V, the working voltage of the lighting device 100 is about 25V, the thickness T of the insulation sheet 140 is 0.5 mm, L2 is 48 mm, and W2 is 32 mm. L1 is 35 mm and W1 is 19 mm. In addition, the reinforced insulation is adopted in this embodiment. Referring to the minimum creepage distance for the lighting devices in major countries and regions of Table 1, the value of creepage distance for the voltage not exceeding 150V of Taiwan and China in the table is 5.5 mm; however, considering the expendability of the lighting device 100 in the future, for example increasing working voltage but not exceeding 250V, Cr value is set to 6.5 mm (the value of creepage distance for the voltage not exceeding 250V of Taiwan and China in table 1 is 6.5 mm). Because of 48 mm+2×0.5 mm>35 mm+2×6.5 mm and 32 mm+2×0.5 mm>19 mm+2×6.5 mm, the correlations L2+2×T≥L1+2×Cr, W2+2×T≥W1+2×Cr and Cr=6.5 mm>1.6 mm are satisfied.

Figure 4:
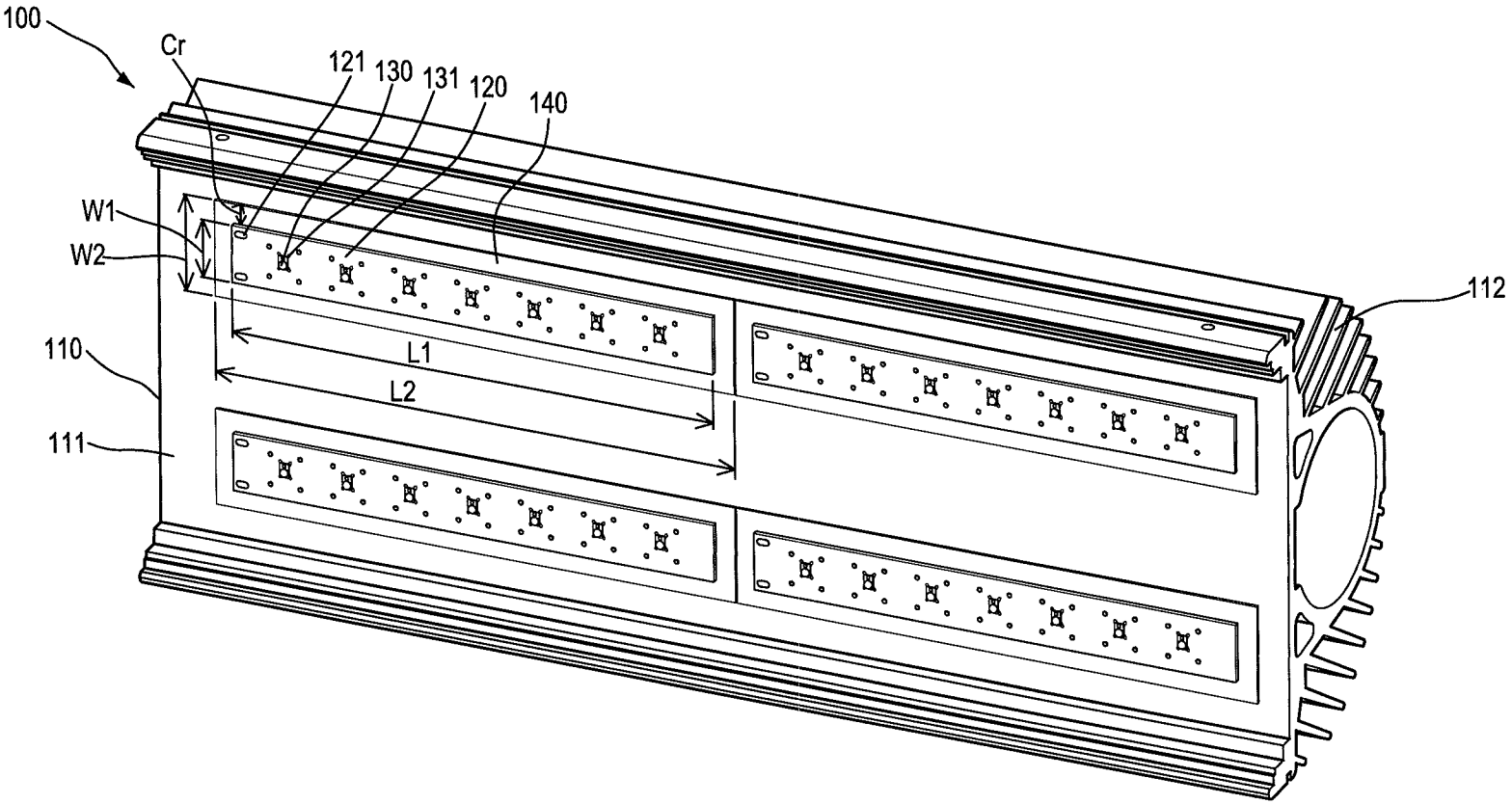
FIG. 4 is a perspective view of a lighting device according to a second preferred embodiment of the present invention.

Please refer to FIG. 4, it is a second embodiment of the present invention. The difference between the first embodiment and the second embodiment lies in that: each substrate 120 has seven LED chips 130 and a set of electrodes 121 for connecting with the main power source, and there are four substrates 120 and four insulation sheets 140 disposed on the surface 111 of the base 110. Under this kind of disposition, the assembly processes can be simplified.

In one embodiment, twenty eight LED chips 130 are used for example. The working current and voltage of the LED chip 130 are 1500 mA and 3.1V, and the working voltage of the lighting device 100 is about 87V. The dimensions of the above-mentioned elements are defined as follows: T is 0.5 mm, L2 is 174 mm, and W2 is 32 mm, L1 is 161 mm and W1 is 19 mm. In addition, the reinforced insulation is adopted in this embodiment. Referring to the minimum specification of creepage distance for the lighting devices in major countries and regions of Table 1, the value of creepage distance for the voltage not exceeding 150V of Taiwan and China in the table is 5.5 mm; however, considering the expendability of the lighting device 100 in the future, for example working voltage is increasing but not exceeding 250V, Cr value is set to 6.5 mm (the value of creepage distance for the voltage not exceeding 250V of Taiwan and China in table 1 is 6.5 mm). Because of 174 mm+2×0.5 mm>161 mm+2×6.5 mm and 32 mm+2×0.5 mm>19 mm+2×6.5 mm, the correlations L2+2×T≥L1+2×Cr, W2+2×T≥W1+2×Cr and Cr=6.5 mm>1.6 mm are satisfied.

Figure 5:
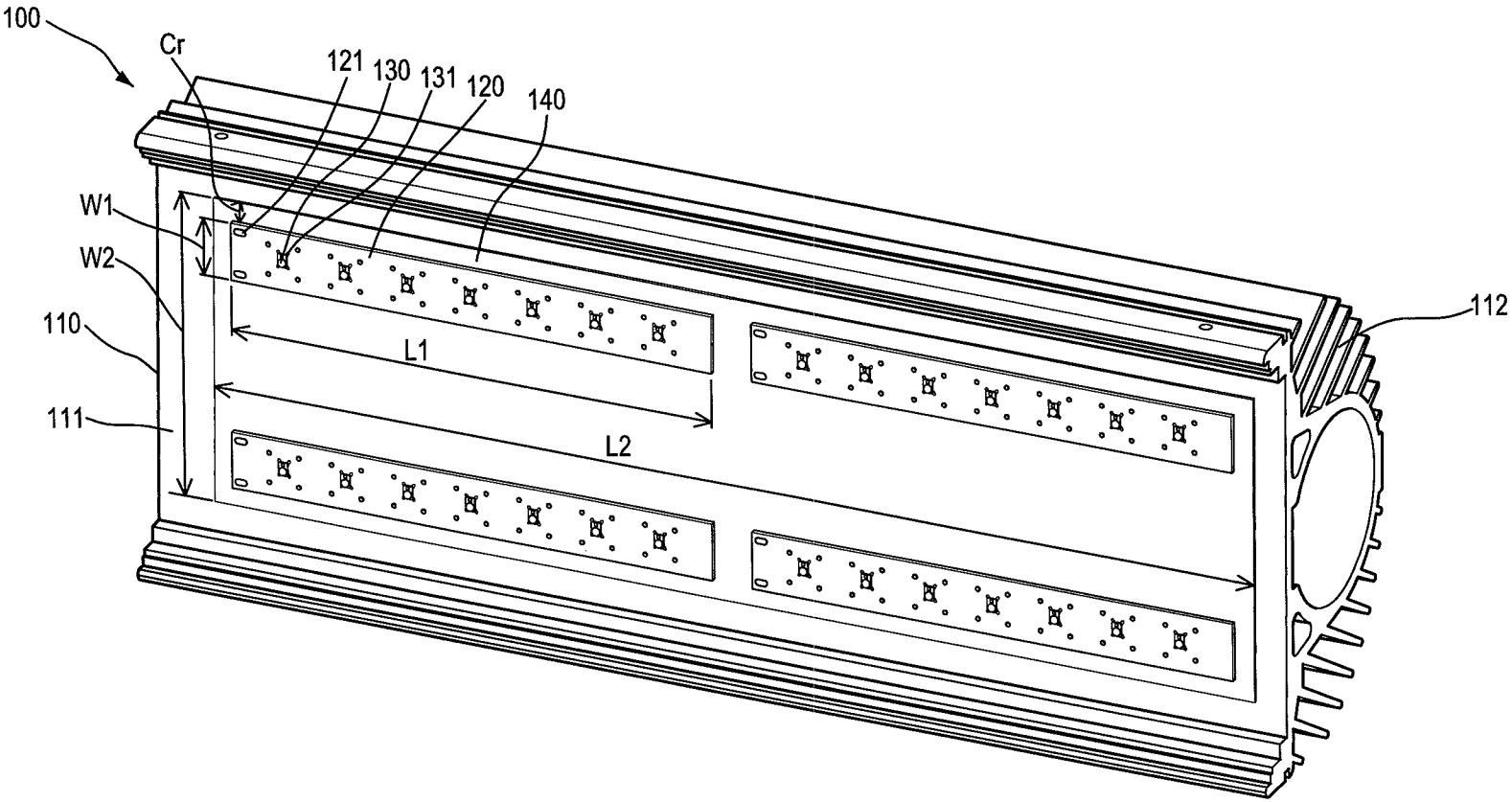
FIG. 5 is a perspective view of a lighting device according to a third preferred embodiment of the present invention.

Please refer to FIG. 5, it is a third embodiment of the present invention. The difference between the second embodiment and the third embodiment lies in that: one insulation sheet 140 is provided for a plurality of substrates 120 disposed thereon. In addition, in the embodiment, one substrate 120 has seven LED chips 130 and a set of electrodes 121 for connecting with the main power source, and there are four substrates 120 and one insulation sheet 140 disposed on the surface 111 of the base 110. Under this kind of disposition, the assembly processes can be simplified.

In one embodiment, twenty eight LED chips 130 are used for example. The working current and voltage of the LED chip 130 are 1500 mA and 3.1V, and the working voltage of the lighting device 100 is about 87V. The dimensions of the above-mentioned elements are defined as follows: T is 0.5 mm, L2 is 348.5 mm, and W2 is 102 mm, L1 is 161 mm and W1 is 19 mm. In addition, the reinforced insulation is adopted in this embodiment. Referring to the minimum specification of creepage distance for the lighting devices in major countries and regions of Table 1, the value of creepage distance for the voltage not exceeding 150V of Taiwan and China in the table is 5.5 mm; however, considering the expendability of the lighting device 100 in the future, for example working voltage is increasing but not exceeding 250V, Cr value is set to 6.5 mm (the value of creepage distance for the voltage not exceeding 250V of Taiwan and China in table 1 is 6.5 mm). Because of 348.5 mm+2×0.5 mm>161 mm+2×6.5 mm and 32 mm+2×0.5 mm>19 mm+2×6.5 mm, the correlations L2+2×T≥L1+2×Cr, W2+2×T≥W1+2×Cr and Cr=6.5 mm>1.6 mm are satisfied.

Moreover, in the embodiments, the insulation sheet 140 may have a function of thermal conduction. The material of the substrate 120 may be an aluminum alloy (manufactured by COFAN TAIWAN Co., Ltd), and the base 110 is made of aluminum (Type 6063T5).

Table 2 is a thickness test sheet of the insulation sheet 140. Table 3 is a thermal conductivity test sheet of the insulation sheet 140. Specimen I is made by INDIAL Co., LTD. (Type A100-42J-2B), Specimen II is made by DENKA Co., LTD. (Type BS40/BS80), Specimen III is a TM series made by EZBOND CHEMICAL CO., TLD (TM 32050/TM 32100/TM 32200/TM 32600), Specimen IV is made by EApus Technology Inc. (Type 86/500), Specimen V is also made by EApus Technology Inc. (Type 86/600). Specimen VI is made by EZBOND CHEMICAL CO., TLD (Type TM 18000 series), Specimen VII is made by DENKA CO., TLD (BFG20/BFG03 of BFG series); Specimen IX is made by DENKA CO., TLD (BS20/BS30 of BS series).

TABLE 2

| | Specimen I | Specimen II | Specimen III | Specimen IV | Specimen V |
|---|---|---|---|---|---|
| Thickness | 0.5 mm | 0.4~0.8 mm | 0.5~6 mm | 0.5~2 mm | 0.5~1.5 mm |
| Effect | Distance through insulation is large, such that the insulation reliability can be satisfied | Distance through insulation is large, such that the insulation reliability can be satisfied | Distance through insulation is large, such that the insulation reliability can be satisfied | Distance through insulation is large, such that the insulation reliability can be satisfied | Distance through insulation is large, such that the insulation reliability can be satisfied |

| | Specimen VI | Specimen VII | Specimen VIII | Specimen IX |
|---|---|---|---|---|
| Thickness | 1~3 mm | 0.1~0.3 mm | 0.2~0.3 mm | 0.2~0.3 mm |
| Effect | Distance through insulation is large, such that the insulation reliability can be satisfied | Distance through insulation is small, such that the insulation reliability can't be satisfied | Distance through insulation is small, such that the insulation reliability can't be satisfied | Distance through insulation is small, such that the insulation reliability can't be satisfied |

TABLE 3

| | Specimen I | Specimen II | Specimen III | Specimen IV | Specimen V |
|---|---|---|---|---|---|
| Thermal conductivity coefficient | 3.0 W/m-K | 3.9 W/m-K | 3.2 W/m-K | 5 W/m-K | 6 W/m-K |
| Effect | The heat in the substrate can be effectively conducted to the base, such that the LED temperature will not go over the operating temperature | The heat in the substrate can be effectively conducted to the base, such that the LED temperature will not go over the operating temperature | The heat in the substrate can be effectively conducted to the base, such that the LED temperature will not go over the operating temperature | The heat in the substrate can be fast and effectively conducted to the base, such that the LED temperature will not go over the operating temperature | The heat in the substrate can be fast and effectively conducted to the base, such that the LED temperature will not go over the operating temperature |

| | Specimen VI | Specimen VII | Specimen VIII | Specimen IX |
|---|---|---|---|---|
| Thermal conductivity coefficient | 1.8 W/m-K | 1.5~2.0 W/m-K | 4.1 W/m-K | 3.9 W/m-K |
| Effect | The heat in the substrate can be effectively conducted to the base, such that the LED temperature will not go over the operating temperature | The heat in the substrate can be effectively conducted to the base, such that the LED temperature will not go over the operating temperature | The heat in the substrate can be effectively conducted to the base, such that the LED temperature will not go over the operating temperature | The heat in the substrate can be effectively conducted to the base, such that the LED temperature will not go over the operating temperature |

In table 2, from the test results of the insulation sheet 140, one can know if the thickness of the insulation 140 is above 0.4 mm, the distance through insulation is large enough and there is no insulation failure problem; therefore, the insulation reliability can be satisfied and the safety of the product can be boosted. However, if the thickness of the insulation sheet 140 is not beyond 0.4 mm, the distance through insulation is small, and the insulation reliability can't be satisfied, so as to downgrade the safety of the product.

In table 3, from the thermal conductivity tests of the insulation sheet 140, one can know when the thermal conductivity is greater than or equal to 1 W/m-K, the heat in the substrate 120 can be effectively conducted to the base 110, such that the LED temperature will not go over the operating temperature. In addition, the problems of lowering light emitting rate as well as life span due to high temperature of LED can be avoided. The thermal conductivity of the insulation sheet 140 is preferably in a range of 1.5 W/m-K≤thermal conductivity≤7 W/m-K.

The preferred embodiments of the present invention have been disclosed in the examples. However the examples should not be construed as a limitation on the actual applicable scope of the invention, and as such, all modifications and alterations without departing from the spirits of the invention and appended claims shall remain within the protected scope and claims of the invention.

What is claimed is:

1. An LED lighting device, at least comprising:

a base made of metal;

a plurality of substrates, each of the substrates having at least one electrode and at least one LED chip electrically connected with the electrode; and a plurality of insulation sheets disposed on a surface of the base, wherein each one of said plurality of substrates is disposed on a respective one of said plurality of insulation sheets with each of the insulation sheets being provided for only one substrate to be disposed thereon, wherein the insulation sheets and the substrates each satisfy correlations $L2+2\times T \geq L1+2\times Cr$, $W2+2\times T \geq W1+2\times Cr$, and $Cr \geq 1.6$ mm; wherein Cr is a shortest distance between the edges of the substrate and the base measured along the surface of the insulation sheet, L1 is a length of the substrate, L2 is a length of the insulation sheet, W1 is a width of the substrate, W2 is a width of the insulation sheet, and T is a thickness of the insulation sheet.

2. The LED lighting device as claimed in claim 1, wherein the base is a case.

3. The LED lighting device as claimed in claim 1, wherein the base has a plurality of heat dissipation fins.

4. The LED lighting device as claimed in claim 1, wherein a thickness of the insulation sheet is greater than or equal to 0.4 mm.

5. The LED lighting device as claimed in claim 1, wherein the insulation sheet further provides a function of thermal conduction.

6. The LED lighting device as claimed in claim 5, wherein a thermal conductivity of the insulation sheet is greater than or equal to 1 W/m-K.

* * * * *